United States Patent [19]

Palmer et al.

[11] Patent Number: 4,759,094

[45] Date of Patent: Jul. 26, 1988

[54] SCRUBBING MACHINE

[75] Inventors: Gary E. Palmer, Roselle; Jerome E. Rau, Hoffman Estates, both of Ill.

[73] Assignee: Hako Minuteman, Inc., Addison, Ill.

[21] Appl. No.: 109,925

[22] Filed: Oct. 19, 1987

[51] Int. Cl.[4] ..... A47L 11/30

[52] U.S. Cl. ..... 15/320; 15/339; 15/340; 15/353; 220/85 B

[58] Field of Search ..... 15/320, 321, 340, 353, 15/50 C, 50 R, 98, 339; 220/22.1, 85 B, 85 A; 137/262, 593

[56] References Cited

U.S. PATENT DOCUMENTS

| | | | |
|---|---|---|---|
| 3,020,576 | 2/1962 | Gerber | 15/320 |
| 3,040,363 | 6/1962 | Krammes et al. | 15/320 |
| 3,896,520 | 7/1975 | Williams | 15/320 |
| 4,196,492 | 4/1980 | Johnson et al. | 15/320 |
| 4,210,978 | 7/1980 | Johnson et al. | 15/320 |
| 4,314,385 | 2/1982 | Wimsatt et al. | 15/321 |
| 4,383,551 | 5/1983 | Lynch et al. | 137/593 |
| 4,467,494 | 8/1984 | Jones | 15/353 |
| 4,586,208 | 5/1986 | Trevarthen | 15/321 |

*Primary Examiner*—Harvey C. Hornsby
*Assistant Examiner*—C. Reinckens
*Attorney, Agent, or Firm*—Emrich & Dithmar

[57] ABSTRACT

A carpet scrubbing machine includes a solution tank for storing cleaning solution and a recovery tank for storing the dirty recovered solution. A molded, shaped flexible pocket is mounted between the tanks and adapted for movement between a normal position in which the pocket extends into the recovery tank and an inverted position in which the pocket extends into the solution tank, thereby providing more room for cleaning solution at the start of a cycle and greater room for recovered solution at the end of a cycle.

10 Claims, 2 Drawing Sheets

SCRUBBING MACHINE

FIELD OF THE INVENTION

The present invention relates to floor cleaning machines; and in particular, it relates to a self-propelled carpet scrubbing machine which sprays a cleaning solution on the carpet, followed by a rotary driven brush to clean the carpet, and then by a recovery shoe which is under vacuum so that the spent (i.e. dirty) solution and loosened dirt are suctioned into the machine. After the machine has traversed a given area, it leaves the carpet not only clean but dry to the extent that the spent solution has been recovered by the vacuum system.

In carpet scrubbing machines there has been a desire to make maximum use of the available space within the machine for storing the clean solution as well as the spent or recovered solution. Increased capacity increases the time during which the operator is actually cleaning carpet, since trips back and forth to refill the solution tank or to discharge spent solution as well as the travel time to and from a maintenance closet are costly and reduce efficiency.

Machines are known which increase the overall storage volume of a machine of a given size by including flexible membranes or bags which separate the clean solution from the spent solution. One such apparatus is disclosed in co-owned U.S. Pat. No. 4,196,492 wherein a flexible bag is attached to a collar; and the collar is mounted to a housing in a forward position in the scrubbing machine housing. Cleaning solution is placed in the bag. The interior of the housing is under vacuum and the spent solution is recovered and stored in the housing surrounding the flexible bag. However, in this structure, the spent or dirty solution is permitted to collect in all crevices of the housing even those surrounding the flexible bag. In order to clean the inside of the housing of the residue deposited on the inside walls from the spent solution, it is necessary to remove the flexible bag and clean all the interior surfaces of the housing including the crevices beneath the flexible bag and the surfaces which contain it. Further, the outside surface of the flexible bag must be cleaned since it is in contact with the spent solution. As a practical matter, the entire exterior of the bag must be cleaned after it is removed since the dirty water is recovered by vacuum and deposited in the space around the bag; and the dirty water typically splashes about the interior of the housing and all over the bag.

Thus, a principal advantage of the present invention is the provision of a scrubbing machine which makes use of the space in what is normally the recovery tank portion of a housing and which is typically not needed upon start up, in order to permit the clean solution to be stored in that area at start up, when the amount of clean solution is at a maximum. The inventive machine then increases the storage volume for the spent solution during use by making use of the space in which the clean solution was originally stored. The present invention achieves this result while facilitating cleaning of the interior of the housing.

SUMMARY OF THE INVENTION

The present invention provides a movable wall in the form of a molded, flexible pocket. The pocket of the illustrated embodiment is in the form of a generally rectilinear tub turned on its side so that the opening is generally vertical. The pocket has a peripheral flange extending about the opening which serves as a seal between the solution and recovery tanks. The flange also provides an attachment means for the molded pocket to secure it to forward and rear housings of the machine. One of the housings, the forward housing in the illustrated embodiment, forms the clean solution (or simply "solution") tank, and the rear housing forms the spent solution (or "recovery") tank.

The molded pocket is made of a synthetic rubber and is of a thickness that it is flexible yet it will retain its original shape under its own weight. This prevents the pocket, which must invert itself during operation, from collapsing and partially sealing itself off from use. The surrounding walls of the pocket from the inlet opening to the opposite vertical end wall are tapered to facilitate the inversion. Further, the vertical end wall of the pocket which is opposite the opening has its central portion formed inwardly of the pocket so that in the start position, the exterior of the vertical wall is generally concave. As spent solution is accumulated in the recovery tank it builds up along the concave exterior surface of the vertical end wall; and as the clean solution is removed from the solution tank, the level of recovered solution will eventually rise above the clean solution and act on the molded pocket, causing it to invert—that is, turn itself inside out—so that the pocket is translated into the clean tank as it does so.

In this manner, one complete side of the molded pocket and all of the interior of the solution tank contact nothing but cleaning solution, whereas the other side of the molded pocket and the interior of the recovery tank are relatively easy to clean because the area which contacts the spent solution is reduced and it is more readily accessible. The shape and structure of the pocket provide enough resistance compared, for example, to a flexible bag that it may be cleaned in place without removing it. The entire interior of the recovery tank and the outside of the pocket can be reached through an access opening in the top of the rear housing for cleaning.

Other features and advantages of the present invention will be apparent to persons skilled in the art from the following detailed description of a preferred embodiment accompanied by the attached drawing wherein identical reference numerals will refer to like parts in the various views.

DETAILED DESCRIPTION OF THE PREFERRED EMBODIMENT

Figure 1:
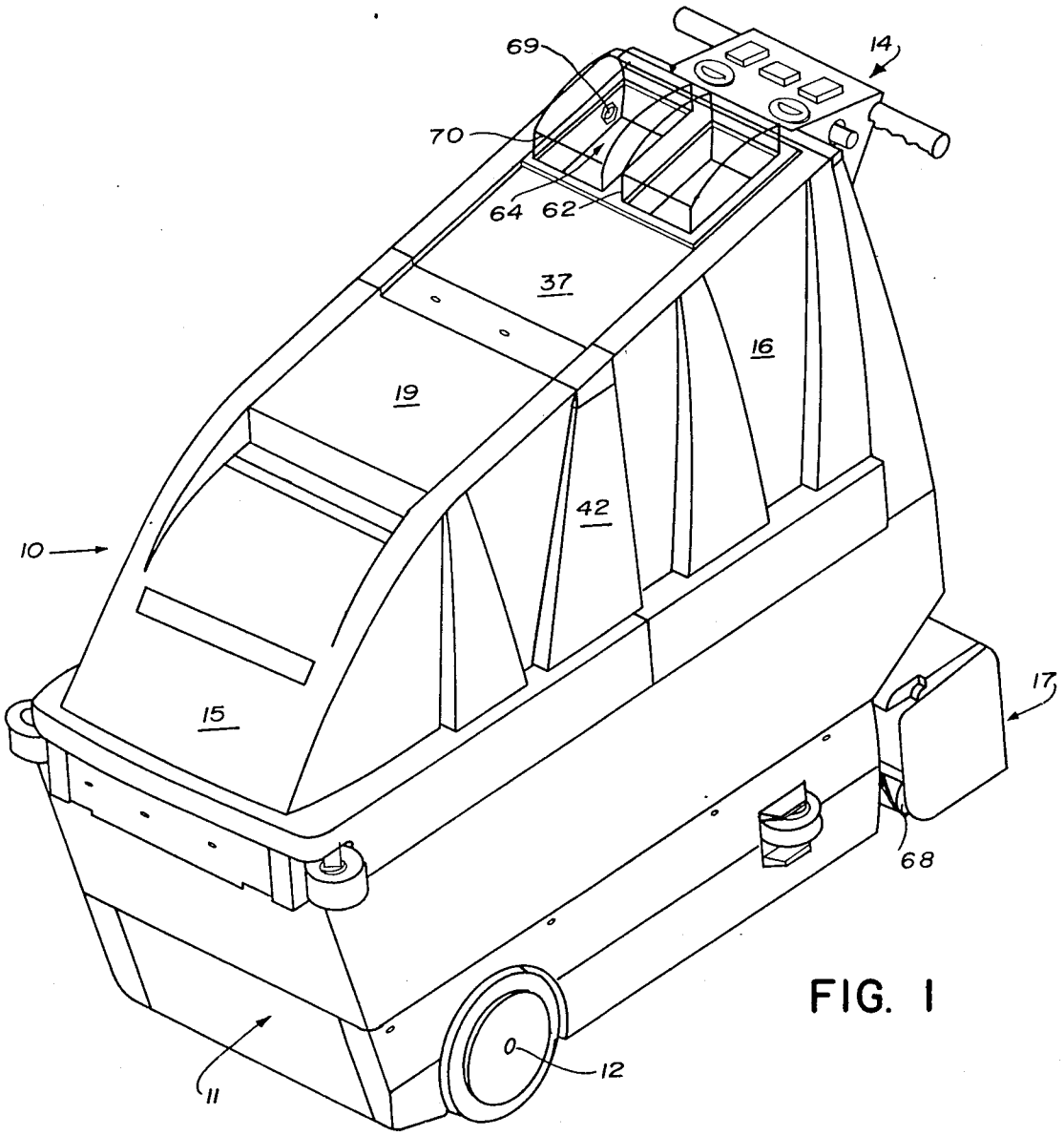
FIG. 1 is an upper frontal perspective view, taken from the left side, of a machine constructed according to the present invention.

Referring first to FIG. 1, a self-propelled scrubbing machine is seen from an upper, front perspective taken from the left side. As used herein, left and right refer to the left and right sides respectively of an operator standing behind the machine and looking in the direction of forward travel.

The overall machine includes an upper hull 10 for storage and a chassis or frame generally designated 11. Forward wheels 12 and rear wheels 13 (FIG. 2) support the chassis. An operator's handle and control generally designated 14 is located near the top and behind the hull.

The main hull 10 includes two separate housings secured together. A front housing 15 forms a reservoir or tank for a cleaning solution, and a rear housing 16 forms a reservoir for the spent or recovered solution.

The front and rear housings 15, 16 are mounted to and supported by the chassis 11. A scrub brush and vacuum recovery assembly generally designated 17 and briefly referred to as the "brush and recovery assembly" is mounted behind rear wheels 13 at the base of the chassis 11.

Cleaning solution is poured through an upper inlet opening 18 in the solution tank which is defined by housing 15. The opening 18 is covered by a cover 19. The cleaning solution flows through an outlet 28 and feed line 29 to a pump 30. The pump 30 feeds a line 32 which supplies the cleaning solution to a spray bar assembly generally designated 35 which is located behind the rear wheels 13 and extends across the width of the machine.

The rear housing 16 which forms the recovery tank has an upper access opening 36 which is covered by a cover 37. A forward connecting flange 40 formed as an integral part of the rear housing 16 is connected to a corresponding rear connecting flange 41 on the forward housing 10. As seen in better detail in the enlarged cross-sectional view of FIG. 3, a peripheral flange 43 of a flexible, molded pocket or boot, generally designated 44, is held between the two connecting flanges 40, 41. A rectangular steel frame member 45 is molded into the flange 43 of the pocket 44 for strength, and the flange 43 of the pocket 44 provides a seal between the connecting flanges 40, 41 of the forward and rear housings as well as a means for attaching the pocket 44 to the front and rear housings at the aligned apertures in those tanks defined by the flanges 40, 41. The pocket 44 is in the shape of a tub having four sides and a bottom which is turned on its side so that the opening of the pocket 44 is in a generally vertical plane. For aesthetic purposes, the flanges are hidden by a multi-piece cover 42 which extends between the front and rear housings in FIG. 1.

Figures 2, 3:
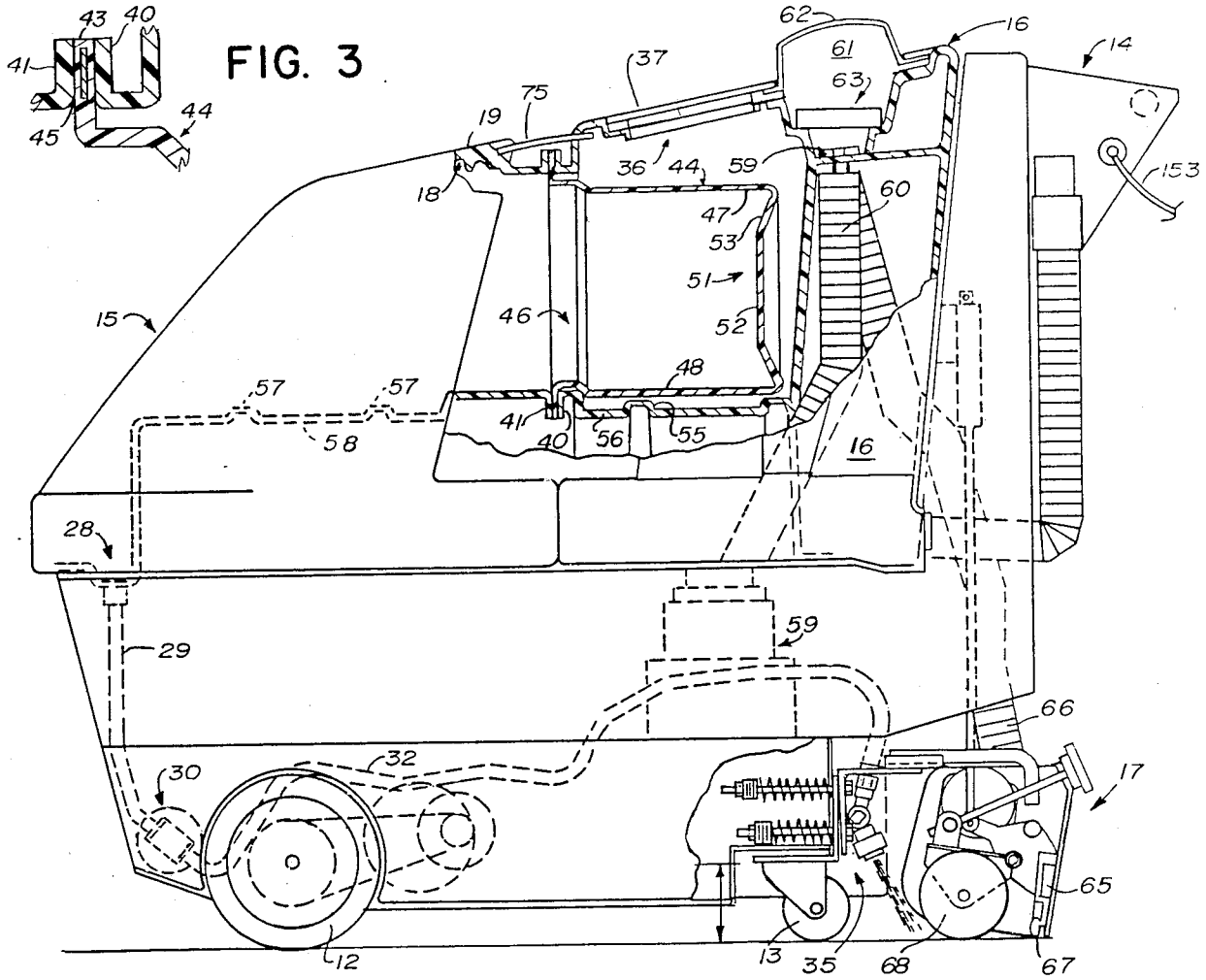
FIG. 2 is an elevational view taken from the left side of the machine of FIG. 1 with portions cut away to view the interior.
FIG. 3 is an enlarged fragmentary vertical cross-sectional view showing the connection of the molded pocket with the front and rear housings of the machine.

The pocket 44, seen in FIG. 2 extending rearwardly and into the recovery tank, is molded of synthetic rubber, such as neoprene. It may have a thickness of approximately 30 mils; and is flexible, yet will retain its molded rectilinear shape under its own weight. Moreover, the pocket 44 may be inverted, but will resume its original shape when brought close to that shape. It is also slightly stretchable, although that is not necessary nor even preferred. The surrounding wall portion of the pocket 44 is formed in the general shape of a box or tub, as mentioned, with the vertical opening defined by flange 44 being located between the tanks. The pocket has surrounding walls including a top wall 47, a bottom wall 48 and two side walls, one of which is seen at 49 in FIG. 2. It also includes a back wall 51. The surrounding walls preferrably taper from the opening to the back wall 51. Although the pocket 44 is shown in the preferred box-like shape, it could also be frustoconical or other shape, if desired.

The back wall 51 preferrably includes a flat central portion 52 and an inclined peripheral portion 53 which extends inwardly toward the center of the box-shape of the pocket from the right-hand portion of the top, bottom, and side walls. Thus, back wall 51 forms a generally vertical wall in a concave shape which facilitates the buckling and inversion of the molded pocket, as will be described more fully below.

The bottom wall 48 is supported by two transverse ribs 55 which are formed in the bottom 56 of the recovery tank housing 16 when the machine is filled with clean solution. When the machine is filled with dirty solution and the pocket inverts, the other surface of the bottom wall 48 rests on ribs 57 formed in a bottom wall portion 58 of the solution tank 15.

A plurality of storage batteries are carried by the chassis 11 to provide power for energizing a reversible drive motor to move the machine in a forward or reverse direction, as determined by the operator's actions at control handle 14. Also mounted to the chassis 11 is a vacuum motor 59, the inlet of which communicates by means of a flexible conduit 60 with an upper plenum 61 in the rear portion of the housing 16, permitting the interior of the housing 16 to be maintained at a subatmospheric pressure (i.e., "vacuum"). The plenum 61 is a chamber which is defined at its upper part by a raised portion 62 of the rear cover 37. Vacuum conduit 60 is mounted to the bottom of plenum 61. Above the vacuum opening are a screen and filter 63 which protect the vacuum opening from the entry of debris. An aperture in the left wall of plenum 61 communicates the interior of the plenum with the interior of the recovery tank housing 16, so the recovery tank is also under vacuum. As seen in FIG. 1, the raised portion 62 of the cover 37 may be made of a transparent plastic such as Plexiglass to seal the top of the plenum 61.

A similar plenum or chamber 64 is formed in the top of housing 16 to the right of the vacuum plenum 61. The chamber 64 is a recovery chamber, and it communicates with a vacuum shoe generally designated 65 by means of a conduit 66. The recovery shoe 65 has a suction inlet 67. An aperture 69 (FIG. 1) formed in the right wall of the recovery chamber 64 communicates the interior of the chamber with the recovery tank so that the vacuum in the recovery tank is communicated through the aperture 69, chamber 64 and conduit 66 to draw a vacuum in the vacuum shoe 65 and thereby recover the solution delivered by the spray bar 35 after a brush 68 cleans the carpet with the solution. The dirty solution is suctioned through the inlet opening 67 in the vacuum recovery shoe 65.

The recovery chamber 64 is also provided with a transparent cover designated 70 in FIG. 1 to seal the recovery chamber and maintain the vacuum.

In operation, the vacuum motor 59 establishes a vacuum in the conduit 60 which is communicated to the plenum 61. The vacuum is in turn communicated to the interior of the recovery tank 16 which is maintained under subatmospheric pressure. Similarly, the vacuum is communicated through the aperture 69 to the right side recovery chamber 64 which couples the negative pressure via flexible conduit 66 to the recovery vacuum shoe 65. Thus, spent cleaning solution is delivered from the recovery shoe 65 through the conduit 66 and into the recovery chamber 64. From the chamber 64, the spent solution is delivered through the aperture 69 and falls under gravity to the bottom of the recovery tank, but the dirty water does not enter the vacuum motor.

Operation of Reversible Pocket

The interior of the recovery tank is in communication with the interior of the solution tank by means of a pair of tubes or conduits one of which is designated 75 in FIG. 2 which extend between housings 15, 16. The purpose of the tubes is to equalize the pressure between the two tanks as will be described further below. Thus, the interior of the solution tank is also kept at a negative pressure which is substantially the same pressure as that of the recovery tank. The inlet opening 18 of the front housing 15 is sealed by means of the cover 19. Cover 37 seals the access opening of the rear housing 16. The reason that the solution tank is maintained at a vacuum level is to maintain the pressure differential across the flexible pocket 44 as low as possible so that moving the pocket from the recovery tank to the solution tank or vice versa is no more difficult in one direction than the other. The reason for the movement or inversion of the molded pocket 44 is that when the pocket is fully located in the recovery tank, as seen in FIG. 2, the volume of cleaning solution that can be maintained in the solution tank is much greater; whereas when the pocket is inverted and is located fully within the solution tank, then the volume of the recovery tank is correspondingly greater.

This feature provides greater room for storing fresh cleaning solution for a machine of given exterior size since the solution may be stored not only in the solution tank, but in the portion defined by the entire volume of the molded pocket 44, as seen in FIG. 2. This increases the storage capacity of the solution tank in the "start" condition, while minimizing the overall volume of the machine because of the minimal volume of the recovery tank 16 needed to begin operation. At the start of a cycle, the weight of the clean solution will force the molded pocket into the recovery tank, which is empty at the beginning of a cycle, as is shown in FIG. 2. As the cleaning solution is forced by the pump 30 through nozzles on the spray bar assembly 35 and the carpet is scrubbed, the spent solution is recovered by vacuum shoe 65 and is delivered through the conduit 66, as described above, into the recovery tank. As the spent solution accumulates in the recovery tank, the solution level in the solution tank lowers and the level of spent solution in the recovery tank rises. Eventually, the solution in the recovery tank will reach a level which will cause the molded pocket 44 to invert its position from that shown in solid line in FIG. 2 to an inverted shape in the solution tank. This inversion occurs, due to the design and structure of the molded pocket 44, by causing the bottom wall 48 of the pocket 44 to buckle upwardly since the accumulating dirty solution flows between the ribs 55 and exerts an upward force on the bottom wall 48. As the solution continues to rise in the recovery tank, the vertical back wall 51, aided by its concave exterior shape, will also buckle and move toward the left, eventually pulling the top wall 47 downwardly and causing the entire molded box to fold on itself and invert by passing through the opening 46 under the force exerted by the spent solution accumulating in the recovery tank. The removal of solution from the solution tank necessary for cleaning assists in this action, as does maintaining both sides of the pocket 44 at substantially the same pressure. The pressure equalization also eliminates any substantial stretching of the pocket material.

The illustrated structure has the advantage that when it is desired to clean the recovery tank and the dirty side of the pocket the cover 37 is opened and the top and sides of the tank and the pocket (as viewed in FIG. 2) are cleaned and washed down. Then the pocket is inverted manually to permit access to the bottom of the recovery tank for cleaning. The underside of the bottom wall 48 of the molded pocket 44 becomes the top surface of the bottom wall when the pocket is inverted, so it can be cleaned at the same time by reaching through the opening 46.

The structure has the advantage of increasing the overall volume of the machine for a given size while avoiding the previous difficulties in being able to clean the interior of the recovery tank and the flexible wall or membrane.

Having thus described in detail a preferred embodiment of the invention, persons skilled in the art will be able to modify certain of the structure which has been illustrated and to substitute equivlent elements for those disclosed while continuing to practice the invention; and it is, therefore, intended that all such modifications and substitutions be covered as they are embraced within the spirit and scope of the appended claims.

We claim:

1. A machine for cleaning a surface including a chassis; a plurality of wheels mounted to said chassis for supporting the same; storage means including a solution tank and a recovery tank for storing clean solution and spent solution respectively and mounted on said chassis in side-by-side relation and having a common opening; dispensing means receiving solution from said solution tank for applying the same to the surface to be treated; recovery means carried by said chassis for recovering said solution after application to said surface and for depositing the recovered solution in said recovery tank; a molded pocket of a material and thickness sufficient to retain a preformed shape under its own weight and flexible enough to be inverted to a correspondingly similar inverted shape and defining a lateral opening; and means for mounting said pocket to said storage means with said lateral opening of said pocket proximate said common opening of said storage and recovery tanks, whereby when cleaning solution is placed in said solution tank and said recovery tank is empty, said pocket extends substantially entirely into said recovery tank in said preformed shape under force of the weight of said solution, and when said recovery tank is storing spent solution and said cleaning tank is substantially empty, the force of said spent solution inverts said pocket and forces it to extend substantially entirely into said solution tank such that said spent solution does not contact the interior of said solution tank.

2. The apparatus of claim 1 wherein said cleaning machine is a carpet scrubbing machine and said dispensing means comprises spray means and a motor receiving cleaning solution from said solution tank for forcing said solution through said spray means for spraying said solution to a carpet to be cleaned; and wherein said recovery means includes: a scrub brush extending transverse of said machine and located behind said spray means for scrubbing said carpet after said spray means has applied said solution to said carpet; vacuum recovery shoe means mounted to said chassis behind said scrub brush; and a vacuum motor for inducing a vacuum in said vacuum recovery shoe for delivering recovered solution to said recovery tank; said machine further comprising means for equalizing the pressure across said molded pocket.

3. The apparatus of claim 2 when said means for equalizing the pressure across said molded pocket comprises means for generating a vacuum in said recovery tank; means communicating the interior of said recovery tank with said recovery shoe to induce a vacuum in said recovery shoe; and conduit means communicating between said recovery tank and said solution tank for equalizing the pressure between said tanks.

4. The apparatus of claim 3 further comprising means providing an access opening in said recovery tank and an inlet opening in said solution tank; and first and second covers for covering and sealing said access opening and said inlet opening respectively thereby to maintain the vacuum in said recovery and solution tanks while permitting access thereto.

5. The apparatus of claim 1 wherein said storage means comprises first and second plastic hull sections located respectively in fore and aft positions on said chassis, each hull defining a peripheral connecting flange adjacent one another, said common opening being defined by said connecting flanges; and wherein said molded pocket defines a peripheral mounting flange extending about said lateral opening thereof and located between the facing connecting flanges of said first and second hull sections; said apparatus further including means for mounting said first and second flanges of said hull sections and said peripheral mounting flange of said pocket means together in sealing relation.

6. The apparatus of claim 5 further comprising a rectangular metal strengthening member molded in the peripheral flange of said pocket and located between the connecting flanges of said first and second hull sections when said pocket is assembled thereto.

7. The apparatus of claim 6 wherein said pocket includes generally planar upper and lower walls extending laterally of said lateral opening therein; first and second generally upright sidewalls; and a vertical wall remote from said lateral opening.

8. The apparatus of claim 7 wherein said vertical wall has a central portion normally located inwardly of the distal ends of said upper, lower, and sidewalls of said pocket to provide a generally concave outer surface when said pocket extends into said recovery tank, whereby as recovered solution accumulates in said recovery tank, said solution engages the concave surface of said pocket, causing the upright wall of said pocket to buckle and lead said pocket in inverting itself into said solution tank as the amount of recovered solution in said recovery tank increases.

9. The apparatus of claim 7 wherein said recovery tank and said solution tank each include a bottom wall, each bottom wall including raised ridge means adopted to support the bottom wall of said pocket when said pocket is fully in the associated tank to space said bottom wall of said pocket above the bottom wall of the associated tank whereby fluid entering the tank in which said pocket is located will cause the bottom wall of said pocket to buckle during the inversion of said pocket and as the level of said fluid rises.

10. The apparatus of claim 1 wherein said pocket includes surrounding wall means about said lateral opening and a generally vertical back wall connected to said surrounding wall means opposite said lateral opening; means being tapered to an increasingly smaller cross-sectional area proceeding from said lateral opening to said back wall.

* * * * *